United States Patent [19]

Tremblay

[11] 4,280,702

[45] Jul. 28, 1981

[54] GAMBLING AID

[76] Inventor: Raymond Tremblay, 1265 Rachel St., East, Apt. 107, Montreal, Canada

[21] Appl. No.: 138,961

[22] Filed: Apr. 10, 1980

[51] Int. Cl.[3] ..... A63F 7/04

[52] U.S. Cl. ..... 273/144 B

[58] Field of Search ..... 273/144 R, 144 A, 144 B; 133/8 A; 206/540; 141/158; 222/478, 454; 215/313, 307

[56] References Cited

U.S. PATENT DOCUMENTS

| | | | |
|---|---|---|---|
| 471,961 | 3/1892 | Deverall | 222/478 X |
| 840,934 | 1/1907 | Grant | 273/144 A |
| 1,348,211 | 8/1920 | Cross | 222/478 X |
| 3,224,779 | 12/1965 | Geleshko | 273/144 A |

FOREIGN PATENT DOCUMENTS

| | | | |
|---|---|---|---|
| 1077300 | 4/1954 | France | 273/144 B |
| 2428877 | 2/1980 | France | 273/144 B |
| 5634 | of 1889 | United Kingdom | 215/313 |
| 6624 | of 1891 | United Kingdom | 215/313 |
| 599569 | 3/1948 | United Kingdom | 222/478 |

*Primary Examiner*—William H. Grieb
*Assistant Examiner*—Arnold W. Kramer

[57] ABSTRACT

An aid for selecting numbers for a game of chance is disclosed, consisting of a hollow container and an elongated hollow tube. The container has an integrally attached outwardly extending projection formed with a hole communicating with the interior of the container. A second hole is formed in one side of the projection, at a right angle to the first mentioned hole. The tube is open at its top end and adapted to be inserted into either hole. A plurality of balls, each marked with a numerical symbol, are provided.

4 Claims, 4 Drawing Figures

GAMBLING AID

FIELD OF THE INVENTION

The present invention relates to gambling, more particularly to an aid for choosing numbers in a game of chance.

BACKGROUND OF THE INVENTION

Gambling is an activity becoming more and more popular, both for participants hoping to experience a lucky win and for governments eager to collect and increase revenue. One of the most widely played games worldwide is the 'lottery' wherein a player chooses several numbers from 36, 40 or 49 possible choices. Unfortunately, many players experience difficulty in deciding how to choose the numbers since the lottery is played at a weekly and even daily tempo.

OBJECTS OF THE INVENTION

Accordingly, it is the prime object of the present invention to provide a simple aid to the selection of elements for a game of chance which assists the imagination.

It is another object of the present invention to provide an aid of the kind described which is non-costly and which calls upon pure chance.

SUMMARY OF THE INVENTION

The invention consists of a hollow, generally symmetrical container having attached to its wall an outwardly extending also generally symmetrical projection. This projection has a hole extending from its outer end through to the container, communicating with the same. A second hole of identical dimension and crosssectional shape as the first hole is formed in the side of the projection and communicates with the first hole.

An elongated hollow tube having the same dimension and crosssectional shape as the two holes is also provided. This tube is provided with a base and is open at its top end.

A plurality of small balls, each having at least six numerical symbols on its surface, complete the assembly of the invention.

The hollow tube fits into the second hole, orthogonal to the projection, when it is desired to use the aid. The container, partially full of balls, is agitated so that a predetermined number of balls roll into the projection and fall into the vertically oriented tube. The number for the lottery is thus read from the numerals appearing on the balls in the tube.

The top end of the hollow tube is formed in such a way that the balls cannot roll out of the first hole of the projection when the tube is inserted into the second hole.

When it is desired to put away or display the aid, the tube may be inserted into the first hole of the projection such that the tube extends inside the container and the base of the former lies flush with the outer side of the projection.

The above will be more clearly understood by having referral to the preferred embodiment of the invention illustrated by way of the accompanying drawing in which:

BRIEF DESCRIPTION OF THE DRAWINGS

Like numerals refer to like elements throughout the drawings.

DESCRIPTION OF THE PREFERRED EMBODIMENT

Figure 1:
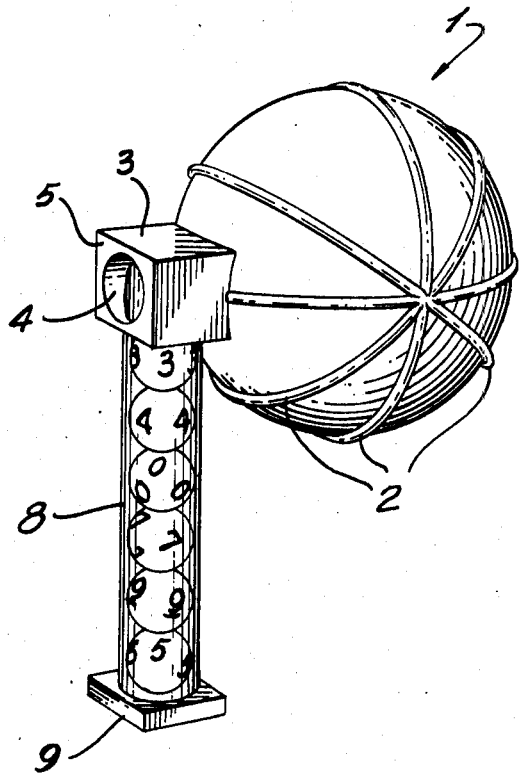
FIG. 1 is a perspective view of the invention in use assembly.
Figure 2:
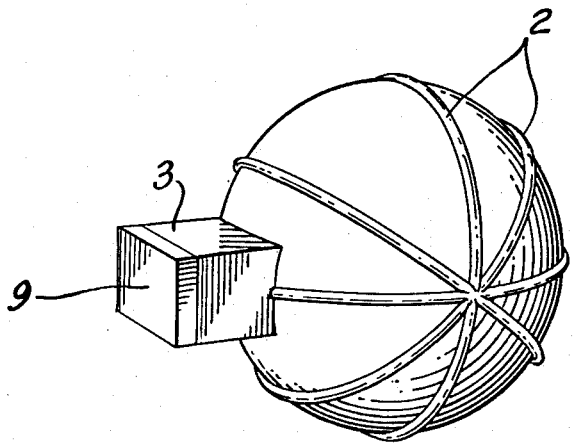
FIG. 2 is a perspective view of the invention in display or storage assembly.

The aid comprises a hollow preferably spherical container 1 made of plastic or other suitable material. The surface of container 1 has a plurality of ribs 2 for a purpose stated below.

An outwardly extending projection 3, square in cross-section and generally cube-shaped, is integrally attached to container 1.

Projection 3 has a circular hole 4 made in its outer side 5 and communicating with the interior of container 1.

A second circular hole 6, of the same dimension as hole 4, is made in one side of projection 3. This hole 6 communicates with hole 4 at a right angle to the latter.

The inside of hollow container 1 is partially filled with a plurality of balls 7, each one marked with several representations of a numerical symbol.

An elongated hollow tube 8, preferably made of transparent and rigid material, has a square base 9 of the same dimensions as the dimensions of the outer side 5 of projection 3. Tube 8 is adapted to fit into hole 4 or hole 6 if the aid is to be displayed or used, respectively.

Figure 3:
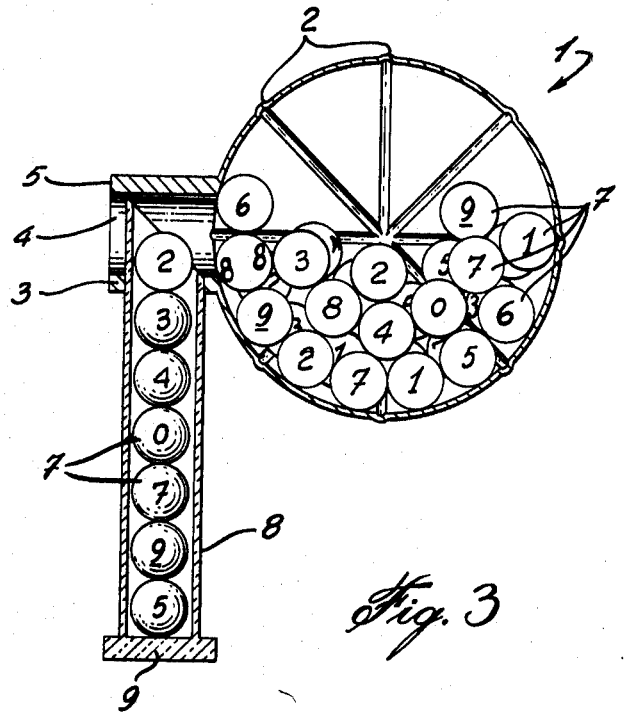
FIG. 3 is a cross-sectional elevation of the invention in use assembly.
Figure 4:
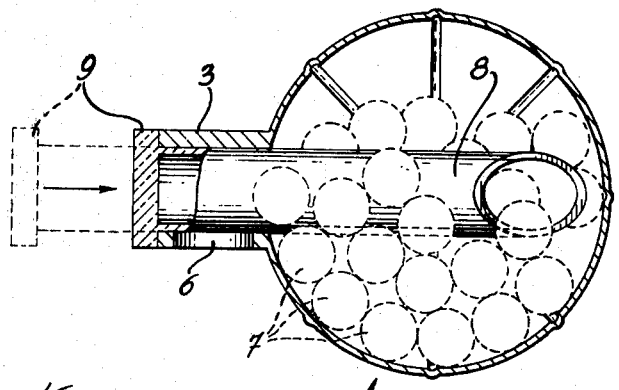
FIG. 4 is a cross-sectional elevation of the invention in storage or display assembly.

As seen clearly in FIGS. 3 and 4, the top end of tube 8 is cut at a 45 degree angle. This is so the balls 7 rolling out of container 1 into tube 8 cannot pass out of projection 3 through hole 4. It will be noted that, once the several balls 7 have fallen into tube 8, the latter can be rotated within hole 6 90 degrees to prevent balls 7 from escaping tube 8 and going back into container 1.

Ribs 2 define inside grooves which serve to ensure that a purely random selection of balls 7 will fall into tube 8 when container 1 is agitated.

When it is desired to store or display the aid, tube 8 may be inserted into hole 4 so that the former extends into container 1 and base 9 is flush with the outer side of projection 3 as clearly shown in FIG. 4. When the aid is assembled in this way, it may be deposed on base 9 with tube 8 being perpendicular to the horizontal.

Tube 8 is held in either hole 4 or 6 by a friction fit.

What I claim is:

1. An aid for games of chance comprising a generally symmetrical hollow container having an outwardly extending generally symmetrical projection; said projection being formed with a first hole formed in its outer side and communicating with the interior of said container; being formed with a second hole of the same dimension and cross-sectional shape as the said first hole and located in one side of said projection at a right angle to said first hole; further comprising a plurality of balls, each inscribed with a different numerical symbol; further comprising an elongated hollow tube of the same cross-sectional dimension and shape as the two holes, said tube being open at the top and adapted to being inserted in either the first hole or the second hole.

2. An aid as defined in claim 1, wherein the top end of said tube is cut at 45 degree angle and is made of transparent material.

3. An aid as defined in claim 1, wherein said container has in its inner surface a plurality of circumferential grooves whereby a random selection of balls is obtained when said container is agitated.

4. An aid as defined in claims 1, 2 or 3, wherein said container is spherical and wherein said tube and holes have a circular cross-section.

* * * * *